US011111919B2

(12) United States Patent
Uekawa

(10) Patent No.: US 11,111,919 B2
(45) Date of Patent: Sep. 7, 2021

(54) SCROLL COMPRESSOR

(71) Applicant: Samsung Electronics Co., Ltd, Suwon-si (KR)

(72) Inventor: Takashi Uekawa, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 161 days.

(21) Appl. No.: 16/503,160

(22) Filed: Jul. 3, 2019

(65) Prior Publication Data

US 2020/0011328 A1 Jan. 9, 2020

(30) Foreign Application Priority Data

Jul. 4, 2018 (JP) ..... JP2018-127719
Jun. 14, 2019 (KR) ..... 10-2019-0070973

(51) Int. Cl.

| | |
|---|---|
| ***F04C 28/20*** | (2006.01) |
| ***F04C 18/02*** | (2006.01) |
| ***F04C 29/00*** | (2006.01) |
| ***F04C 28/08*** | (2006.01) |
| ***F01C 20/22*** | (2006.01) |
| ***F04C 29/12*** | (2006.01) |

(52) U.S. Cl.

CPC ..... *F04C 18/0215* (2013.01); *F04C 18/0246* (2013.01); *F04C 29/0057* (2013.01); *F04C 29/12* (2013.01); *F04C 2250/10* (2013.01); *F04C 2250/20* (2013.01)

(58) Field of Classification Search

CPC ..... F04C 18/0215; F04C 18/0246; F04C 29/0057; F04C 28/08; F04C 28/20; F01C 20/22

See application file for complete search history.

(56) References Cited

U.S. PATENT DOCUMENTS

2002/0064472 A1 5/2002 Bush et al.
2005/0220650 A1* 10/2005 Park ..... F04C 18/0215 418/55.3

(Continued)

FOREIGN PATENT DOCUMENTS

EP 0718500 A1 * 6/1996 ..... F04C 29/0057
JP 2013245614 A 12/2013

(Continued)

OTHER PUBLICATIONS

International Search Report dated Oct. 28, 2019 in connection with International Patent Application No. PCT/KR2019/008120, 3 pages.

(Continued)

*Primary Examiner* — Deming Wan

(57) ABSTRACT

A scroll compressor includes a fixed scroll fixed inside a housing, an orbiting scroll configured to orbit engaged with the fixed scroll, a rotary shaft configured to allow the orbiting scroll to orbit by supporting the orbiting scroll with an eccentric shaft eccentric from a main shaft, and a slide bush portion installed between a bearing of the orbiting scroll and the eccentric shaft and according to a rotational speed of the rotary shaft, configured to change a pressing force of the orbiting scroll applied to the fixed scroll by allowing an eccentricity to be changed by a gas load applied to the orbiting scroll.

18 Claims, 7 Drawing Sheets

(56) References Cited

U.S. PATENT DOCUMENTS

| | | | | |
|---|---|---|---|---|
| 2006/0233654 | A1* | 10/2006 | Gopinathan | F04C 18/0215 418/54 |
| 2009/0155110 | A1* | 6/2009 | Vondenstein | F04C 28/22 418/16 |
| 2009/0246057 | A1 | 10/2009 | Sugimoto et al. | |
| 2011/0243775 | A1* | 10/2011 | Park | F04C 28/08 418/55.1 |
| 2018/0080445 | A1 | 3/2018 | Lee et al. | |

FOREIGN PATENT DOCUMENTS

| | | | |
|---|---|---|---|
| KR | 10-0202622 | B1 | 6/1999 |
| KR | 10-2016-0116247 | A | 10/2016 |

OTHER PUBLICATIONS

Supplementary European Search Report dated Mar. 22, 2021 in connection with European Patent Application No. EP 19 82 9902, 7 pages.

* cited by examiner

SCROLL COMPRESSOR

CROSS-REFERENCE TO RELATED APPLICATIONS

This application is based on and claims priority under 35 U.S.C. 119 to Korean Patent Application No. 10-2019-0070973 filed on Jun. 14, 2019 in the Korean Intellectual Property Office, which claims the benefit of Japanese Patent Application No. 2018-127719 filed on Jul. 4, 2018 in the Japan Patent Office, the disclosures of which are herein incorporated by reference in their entireties.

BACKGROUND

1. Field

The disclosure relates to a scroll compressor.

2. Description of Related Art

A scroll compressor is operated as follows. A fixed scroll and an orbiting scroll that orbits about the fixed scroll are provided, and a wrap in the spiral shape is formed on a surface of a panel of the fixed scroll and the orbiting scroll, respectively, and the surfaces face to each other.

A plurality of compression chambers is formed as wraps are in meshing engagement with each other, and a slide bush, which has a slide surface having a predetermined angle about a load direction of gas in the compression chamber, is provided in an eccentric shaft of the rotary shaft driving the orbiting scroll. Therefore, when the load of gas in the compression chamber is applied, an eccentricity of the eccentric shaft is increased.

When the scroll compressor employs a structure in which the eccentricity of the orbiting scroll is increased upon the application of the load of gas in the compression chamber, regardless of a rotational speed of a rotary shaft of the orbiting scroll, that is when the rotary shaft of the orbiting scroll is rotated at a high speed, there is a problem that the orbiting scroll applies an excessive pressing force to the fixed scroll.

SUMMARY

Therefore, it is an aspect of the present disclosure to provide a scroll compressor capable of suppressing excessive pressing forces of an orbiting scroll applied to a fixed scroll.

Additional aspects of the present disclosure will be set forth in part in the description which follows and, in part, will be obvious from the description, or may be learned by practice of the present disclosure.

In accordance with an aspect of the disclosure, a scroll compressor includes a fixed scroll fixed inside a housing, an orbiting scroll configured to orbit engaged with the fixed scroll, a rotary shaft configured to allow the orbiting scroll to orbit by supporting the orbiting scroll with an eccentric shaft eccentric from a main shaft, and a slide bush portion installed between a bearing of the orbiting scroll and the eccentric shaft and according to a rotational speed of the rotary shaft, configured to change a pressing force of the orbiting scroll applied to the fixed scroll by allowing an eccentricity to be changed by a gas load applied to the orbiting scroll.

The slide bush portion may suppress a pressing force of the orbiting scroll applied to the fixed scroll when the rotary shaft is rotated at a high rotational speed, and the orbiting scroll may compress the fixed scroll when the rotary shaft is rotated at a low rotational speed.

The slide bush portion may suppress the pressing force of the orbiting scroll applied to the fixed scroll by suppressing the eccentricity in the main shaft of the orbiting scroll.

The slide bush portion may include a slide bush inserted and coupled to the bearing of the orbiting scroll, and an inner bush installed between the slide bush and the eccentric shaft and inserted and coupled to the eccentric shaft.

A center of gravity of the slide bush and the inner bush may be at a position delayed in the rotational direction of the rotary shaft with respect to a straight line connecting the center of the main shaft to the center of the eccentric shaft.

The slide bush and the inner bush may include a first slide surface and a second slide surface, respectively, and the first slide surface may be in contact with the second slide surface so that the slide bush is rotated in accordance with the rotation of the inner bush.

The eccentric shaft may include a stopper configured to restrict the rotation of the inner bush, and the inner bush may include a protrusion configured to restrict the rotation of the inner busy by being in contact with the stopper.

A clearance may be provided between the slide bush and the inner bush, and the slide bush may be moved with respect to the inner bush such a way that the first slide surface slides along the second slide surface by the clearance.

A first torque generated by the rotation of the bearing of the orbiting scroll and a second torque generated by the centrifugal force on the slide bush and the inner bush may be applied to the slide bush and the inner bush.

The stopper may include a first stopper configured to restrict a counterclockwise rotation of the inner bush, and a second stopper configured to restrict a clockwise rotation of the inner bush.

When the rotary shaft is rotated at a low rotational speed, the first torque may become greater than the second torque and thus in a state in which a straight line connecting the center of the eccentric shaft to the center of the slide bush and the inner bush is rotated counterclockwise by 45 degree with respect to the horizontal line passing the center of the eccentric shaft, the protrusion may be brought into contact with the first stopper, thereby restricting the rotation.

In a state in which the inner bush is rotated counterclockwise by 45 degree, the slide bush may be moved such a way that by a gas load applied to the orbiting scroll, the first slide surface slides along the second slide surface in a direction, in which the eccentricity is increased, by the clearance.

When the rotary shaft is rotated at a high rotational speed, the first torque may become less than the second torque and thus in a state in which a straight line connecting the center of the eccentric shaft to the center of the slide bush and the inner bush is rotated clockwise by 45 degree with respect to the horizontal line passing the center of the eccentric shaft, the protrusion may be brought into contact with the second stopper, thereby restricting the rotation.

In a state in which the inner bush is rotated clockwise by 45 degree, the slide bush may be moved such a way that by a gas load applied to the orbiting scroll, the first slide surface slides along the second slide surface in a direction, in which the eccentricity is reduced, by the clearance.

The first torque may change as a linear function of the rotational speed of the rotary shaft and the second torque may change as a quadratic function of the rotational speed of the rotary shaft.

In accordance with an aspect of the disclosure, a scroll compressor includes a fixed scroll fixed inside a housing, an orbiting scroll configured to orbit engaged with the fixed scroll, a rotary shaft configured to allow the orbiting scroll to orbit by supporting the orbiting scroll with an eccentric shaft eccentric from a main shaft; and a slide bush portion installed between a bearing of the orbiting scroll and the eccentric shaft and configured to change a pressing force of the orbiting scroll applied to the fixed scroll, and the slide bush portion includes a slide bush inserted and coupled to a bearing of the orbiting scroll and including a first slide surface, and an inner bush installed between the slide bush and the eccentric shaft and inserted and coupled to the eccentric shaft and including a second slide surface in contact with the first slide surface to allow the slide bush to be rotated together, and according to the rotational speed of the rotary shaft, the first slide surface of the slide bush slides along the second slide surface of the inner bush by a gas load applied to the orbiting scroll and thus the eccentricity is changed.

The slide bush portion may suppress a pressing force of the orbiting scroll applied to the fixed scroll when the rotary shaft is rotated at a high rotational speed, and the orbiting scroll compresses the fixed scroll when the rotary shaft is rotated at a low rotational speed.

The slide bush portion may suppress the pressing force of the orbiting scroll applied to the fixed scroll by suppressing the eccentricity in the main shaft of the orbiting scroll.

At least one of the slide bush and the inner bush may include a balance weight configured to adjust a center of gravity of the slide bush and the inner bush.

At least one of the slide bush and the inner bush may include a balance hole configured to adjust a center of gravity of the slide bush and the inner bush.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter embodiments of the disclosure will be described in detail with reference to the accompanying drawings.

Figure 1:
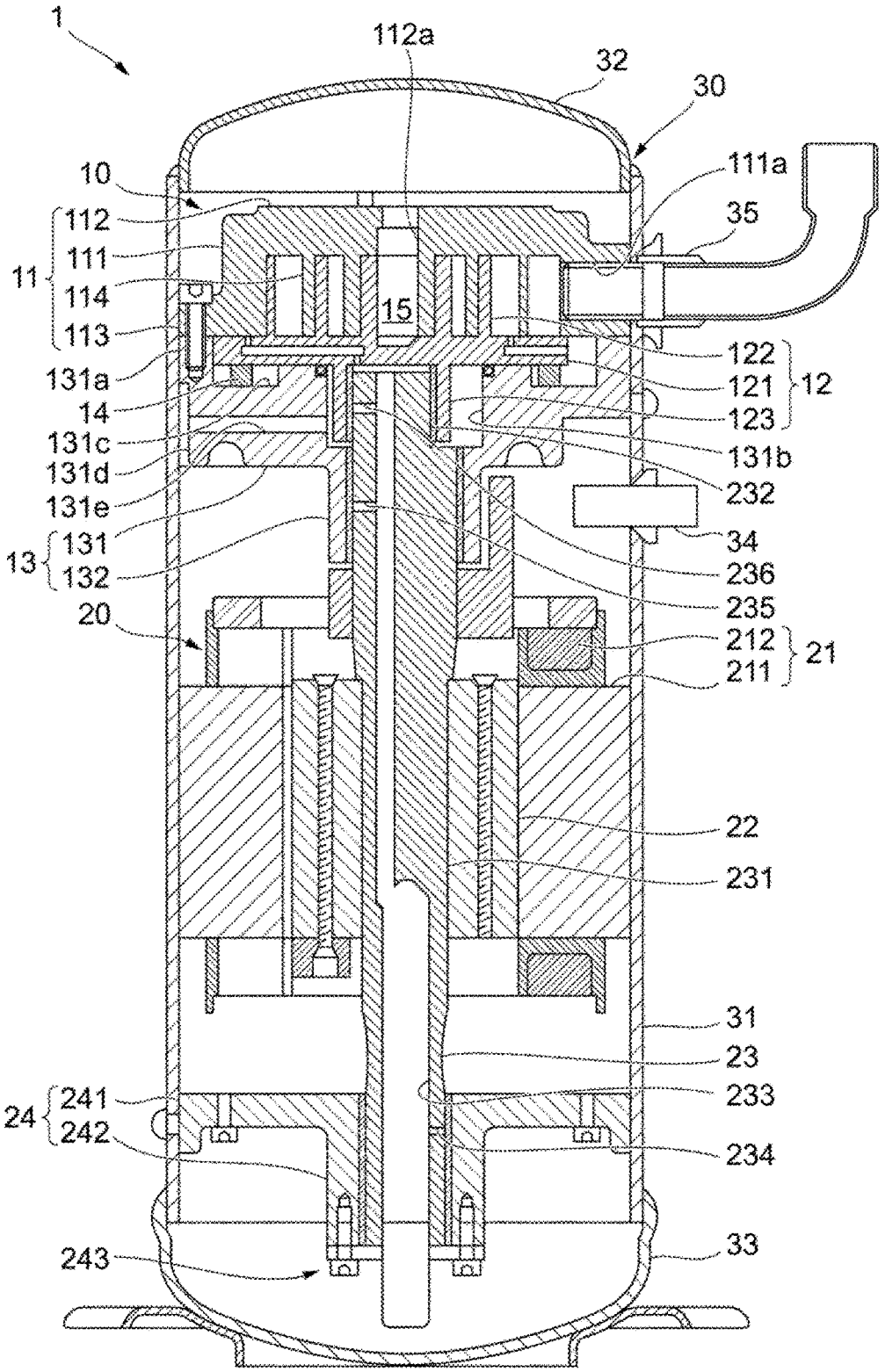
FIG. 1 illustrates an axial cross-sectional view of a scroll compressor according to an embodiment of the disclosure.

FIG. 1 illustrates an axial cross-sectional view of a scroll compressor 1 according to an embodiment of the disclosure.

The scroll compressor 1 is a compressor widely used for an air conditioner, a freezer, and a heat pump. FIG. 1 is a longitudinal sectional view of a hermetic scroll compressor used in a refrigerant circuit of an air conditioner.

The scroll compressor 1 includes a compression portion 10 configured to compress a refrigerant, a drive motor 20 configured to drive the compression portion 10, and a casing 30 corresponding to a housing configured to receive the compression portion 10 and the drive motor 20. According to an embodiment, the scroll compressor 1 is a vertical scroll compressor in which an axial direction of a rotary shaft 23, which will be described later, of the drive motor 20 is coincident with the gravity direction. Hereinafter the axial direction of the rotary shaft 23 will be referred to as "vertical direction", and based on FIG. 1, the upper side may be referred to as "upper side" and the lower side as "lower side". Although the vertical scroll compressor is described as an example, but the embodiment of the disclosure will be applicable to a horizontal scroll compressor.

First, the compression portion 10 will be described.

The compression portion 10 includes a fixed scroll 11 fixed to the casing 30, an orbiting scroll 12 orbiting by being engaged with the fixed scroll 11, a frame 13 fixed to the casing 30 and configured to support the fixed scroll 11, and an Oldham ring 14 configured to allow the orbiting scroll 12 to orbit without pivoting the orbiting scroll 12.

The fixed scroll 11 includes a cylindrical portion 111 having a cylindrical shape, an end plate 112 configured to cover an opening in an upper side of the cylindrical portion 111, and a protrusion 113 extending from a lower end of the cylindrical portion 111 in radially outward direction. Further, the fixed scroll 11 includes a fixed side spiral portion 114 extending downward from a lower end of the end plate 112 and having a spiral shape when viewed from below. The fixed scroll 11 may be formed of cast iron such as gray iron FC 250.

The cylindrical portion 111 is provided with a through hole 111*a* in the radial direction. The through hole 111*a* may serve as a suction port configured to suction the refrigerant into a space surrounded by the cylindrical portion 111, the end plate 112 and the orbiting scroll 12.

A through hole 112*a* in the vertical direction is formed at the center of the end plate 112. The through hole 112*a* may serve as a discharge port configured to discharge the refrigerant from the space surrounded by the end plate 112, the fixed side spiral portion 114 and the orbiting scroll 12.

The fixed scroll 11 constructed as described above is fixed to the frame 13 by a positioning means such as a bolt or a positioning pin passed through the through hole in the vertical direction formed in the protrusion 113.

The orbiting scroll 12 includes an end plate 121 having a disk shape, an orbiting side spiral portion 122 extending upward from an upper end of the end plate 121 and having a spiral shape when viewed from above, a cylindrical portion 123 extending from a lower end of the end plate 121 downward and having a cylindrical shape. The orbiting scroll 12 may be formed of FC material or FCD material.

The orbiting side spiral portion 122 is a spiral body in mesh engagement with the fixed side spiral portion 114 of the fixed scroll 11. The orbiting side spiral portion 122 and the fixed side spiral portion 114 of the fixed scroll 11 are placed in a space between the cylindrical portion 111 and the end plate 112 of the fixed scroll 11, and the end plate 121 of the orbiting scroll 12. The orbiting side spiral portion 122 and the fixed side spiral portion 114 forms a compression chamber 15. Because the orbiting side spiral portion 122 is circularly moved about the fixed side spiral portion 114 that is fixed, a volume of the compression chamber 15 is reduced and the refrigerant of the compression chamber 15 is compressed. In other words, as an internal space between the fixed side spiral portion 114 and the orbiting side spiral portion 122 is reduced toward a center of rotation, the refrigerant is compressed.

An eccentric shaft 232 of a rotary shaft 23, which is described later, is inserted into the cylindrical portion 123 through a sliding bearing. As described above, the cylindrical portion 123 functions as a bearing of the eccentric shaft 232.

The frame 13 includes a first cylindrical portion 131 having a cylindrical shape, and a second cylindrical portion 132 extending downward from the lower end of the first cylindrical portion 131 to have a cylindrical shape. An outer circumferential surface of the first cylindrical portion 131 of the frame 13 is fixed to a central casing 31 of the casing 30, which is described later. In addition, the rotary shaft 23 of the drive motor 20, which is described later, is inserted into the inside of the first cylindrical portion 131 and the second cylindrical portion 132 using a journal bearing. As mentioned above, the frame 13 also functions as a bearing for rotatably supporting the rotary shaft 23.

In an outer circumferential portion of the first cylindrical portion 131, a protrusion 131*a* protruding upward from the upper end surface is installed. A female screw is formed in the protrusion 131*a*, and a bolt, which passed through the through hole formed in the protrusion 131*a* of the fixed scroll 11, is engaged with the female screw. Therefore, the fixed scroll 11 is fixed to the frame 13.

In addition, the first cylindrical portion 131 is provided with a first concave portion 131*b* and a second concave portion 131*c*, which are concave downward from the upper end surface. In the radial direction, the first concave portion 131*b* is formed at the center, and the second concave portion 131*c* is formed between the first concave portion 131*b* and the protrusion 131*a*. The cylindrical portion 123 of the orbiting scroll 12 is inserted into the first concave portion 131*b*. The Oldham ring 14 arranged between the frame 13 and the orbiting scroll 12 to prevent the orbiting scroll 12 from pivoting is arranged in the second concave portion 131*c*.

In addition, a groove 131*d* extending in the vertical direction over the lower portion from the center of the outer circumferential portion is formed in the first cylindrical portion 131. Further, a communication hole 131*e* formed in the radial direction to communicate the inside of the first concave portion 131*b* and the groove 131*d* is formed in the first cylindrical portion 131.

The rotary shaft 23 is inserted and coupled to an inner circumference of the second cylindrical portion 132 through a journal bearing, and the second cylindrical portion 132 functions as a bearing for rotatably supporting the rotary shaft 23.

In the above-mentioned compression portion 10, a discharge passage (not shown) for discharging the refrigerant compressed by the fixed scroll 11 and the orbiting scroll 12 is formed. As for the discharge passage, one end is connected to the through hole 112*a* of the end plate 112, which is configured to discharge the refrigerant from the space surrounded by the fixed scroll and the orbiting scroll 12, and the other is connected to a space lower than the frame 13 in the casing 30.

Next, the drive motor 20 will be described.

The drive motor 20 is fixed to the casing 30 under the compression portion 10.

The drive motor 20 includes a stator 21, a rotor 22, the rotary shaft 23 supporting the rotor 22 and rotating with respect to the casing 30, and a support member 24 rotatably supporting the rotary shaft 23.

The stator 21 includes a stator body 211 and a coil 212 wound around the stator body 211.

The stator body 211 is a laminated body in which a plurality of electrical steel sheets is laminated, and has an approximately cylindrical shape. A diameter of an outer circumferential surface of the stator body 211 is formed greater than a diameter of an inner circumferential surface of the central casing 31 of the casing 30 which is described later. The stator body 211 (stator 21) is forcedly inserted to the central casing 31. A method for inserting the stator body 211 to the central casing 31 may employ shrink fitting or press fitting method Further, the stator body 211 has a plurality of teeth (not shown) in the circumferential direction on the inner side portion facing the outer circumference of the rotor 22. The coil 212 is arranged in a slot (not shown) formed between adjacent tooth. In the stator 21 according to the embodiment, a concentrated winding, in which the coil 212 is inserted into a slot placed between a plurality of adjacent tooth, is described as an example of the coil 212.

The rotor 22 is a laminated body in which a plurality of electrical steel sheets having a ring shape is laminated, and has an approximately cylindrical shape. A diameter of an inner circumferential surface of the rotor 22 is formed less than the diameter of an outer circumferential surface of the rotary shaft 23. The rotor 22 is forcedly inserted to the rotary shaft 23. A method for inserting the rotor 22 to the rotary shaft 23 may employ the press fitting method. The rotor 22 is fixed to the rotary shaft 23 and rotates together with the rotary shaft 23. Further, a rotor in which one permanent magnet is embedded therein is described as an example of the rotor 22.

The diameter of the outer circumferential surface of the rotor 22 is less than the diameter of the inner circumferential surface of the stator body 211 of the stator 21 and a gap is formed between the rotor 22 and the stator 21.

The rotary shaft 23 include a main shaft 231 to which the rotor 22 is fitted and coupled, and the eccentric shaft 232 provided on the upper portion of the main shaft 231 and having an axis eccentric from the axis of the main shaft 231.

The lower portion of the main shaft 231 is rotatably supported by the support member 24 and the upper portion of the main shaft 231 is rotatably supported by the frame 13 of the compression portion 10. The eccentric shaft 232 is rotatably supported by the cylindrical portion 123 of the orbiting scroll 12.

The rotary shaft 23 is provided with a through hole 233 passing through the rotary shaft 23 in the axial direction. In the rotary shaft 23, a first communication hole 234 communicating the through hole 233 with the bearing of the support member 24, a second communication hole 235 communicating the through hole 233 with the bearing of the frame 13, and a third communication hole 236 communicating the through hole 233 with the bearing of the cylindrical portion 123 are formed.

The support member 24 includes a first cylindrical portion 241 having a cylindrical shape, and a second cylindrical portion 242 extending downward from the lower end of the first cylindrical portion 241 to have a cylindrical shape. The support member 24 is fixed to the central casing 31 such a way that an outer circumferential surface of the first cylindrical portion 241 is fixed to an inner circumferential surface of the central casing 31 of the casing 30 which is described later. In addition, the rotary shaft 23 is inserted into the inside of the first cylindrical portion 241 and the second cylindrical portion 242 using a journal bearing. As mentioned above, the support member 24 functions as a bearing for rotatably supporting the rotary shaft 23.

In addition, in the first cylindrical portion 241, a hole (not shown) or a groove (not shown) communicating an upper space than the first cylindrical portion 241 with a lower space than the first cylindrical portion 241 is formed.

A pump 243 pumping lubricant is mounted to the lower end of the second cylindrical portion 242 of the support member 24.

Next, the casing 30 will be described.

The casing 30 includes the central casing 31 arranged in the center in the vertical direction and having a cylindrical shape, an upper casing 32 covering an upper opening of the central casing 31, and a lower casing 33 covering a lower opening of the central casing 31. Further, the casing 30 includes a discharge portion 34 discharging the high pressure refrigerant compressed by the compression portion 10 to the outside of the casing 30, and a suction portion 35 suctioning the refrigerant from the outside of the casing 30.

The frame 13 of the compression portion 10 and the stator 21 and the support member 24 of the drive motor 20 are fixed to the central casing 31 as described above. The discharge portion 34 and the suction portion 35 are provided by inserting a pipe into a through hole formed in the central casing 31. The suction portion 35 is installed at a position corresponding to the through the through hole 111*a* formed in the cylindrical portion 111 of the fixed scroll 11. The suction portion 35 suctions the refrigerant from the outside of the casing 30 into the space surrounded by the fixed scroll 11 and the orbiting scroll 12.

The lower casing 33 is formed in a bowl shape and thus lubricant can be stored.

Next, the operation of the scroll compressor 1 will be described.

When the drive motor 20 of the scroll compressor 1 drives, the rotary shaft 23 rotates and the orbiting scroll 12 fitted in the eccentric shaft 232 of the rotary shaft 23 orbits about the fixed scroll 11. As the orbiting scroll 12 orbits about the fixed scroll 11, the low pressure refrigerant is suctioned from the outside of the casing 30 into the space surrounded by the fixed scroll 11 and the orbiting scroll 12 through the suction portion 35. The refrigerant is compressed in accordance with the volume change of the compression chamber 15. The high-pressure refrigerant compressed in the compression chamber 15 is discharged to the lower side of the compression portion 10.

The high-pressure refrigerant discharged to the lower side of the compression portion 10 is discharged to the outside of the casing 30 through the discharge portion 34 provided in the casing 30. In the process of being discharged to the outside of the casing 30, the high-pressure refrigerant is distributed to the gap between the rotor 22 and the stator 21 and the gap between the stator 21 and the central casing 31. The high-pressure refrigerant discharged to the outside of the casing 30 is suctioned from the suction portion 35 again after each operation of condensation, expansion and evaporation in the refrigerant circuit.

On the other hand, the lubricant stored in the lower casing 33 of the casing 30 is pumped up by the pump 243 and raised through the through hole 233 formed in the rotary shaft 23. The raised lubricant is supplied to each bearing of the rotary shaft 23 through the first communication hole 234, the second communication hole 235 and the third communication hole 236 formed in the rotary shaft 23, or is supplied to a sliding member of the compression portion 10. The lubricant, which is supplied to the sliding member of the compression portion 10 or the lubricant supplied to the bearing of the rotary shaft 23 through the first communication hole 234, the second communication hole 235 and the third communication hole 236, is returned to the lower casing 33 through the communication hole 131*e* and the groove 131*d* formed in the frame 13, the gap between the rotor 22 and the stator 21, and the axial direction hole formed in the support member 24, and then stored in the lower portion of the casing 30. In this process and in the process in which the high-pressure refrigerant is distributed to the gap between the rotor 22 and the stator 21 before being discharged to the outside of the casing 30, the lubricant and the refrigerant flow into the low pressure side while cooling the drive motor 20. The lubricant, which is distributed together with the high pressure refrigerant, is separated from the refrigerant and then stored in the lower portion of the casing 30.

However, the scroll compressor 1 may be equipped with a slide bush portion. The slide bush portion is a mechanism for improving the adherence effect by pressing the orbiting scroll 12 against the fixed scroll 11 by using the compressive load of gas corresponding to the refrigerant suctioned from the through hole 111*a*.

On the other hand, in recent years, it has been demanded that the rotational speed of the rotary shaft 23 can be set broadly from low speed to high speed as wide range is used.

However, in the conventional slide bush portion, when the rotary shaft 23 is rotated at a high speed, excessive pressing forces of the orbiting scroll 12 applied to the fixed scroll 11 is generated due to the centrifugal force. Therefore, it is difficult to install the conventional slide bush portion on the scroll compressor 1 in which the rotational speed of the rotary shaft 23 is variable.

Therefore, according to the embodiment, the scroll compressor 1 capable of providing the adhesion effect only at the low speed rotation of the rotary shaft 23 is implemented by using the slide bush portion configured to be operated at the low speed rotation of the rotary shaft 23 and configured to prevent an excessive pressing force at the high speed rotation of the rotary shaft 23.

Figure 2:
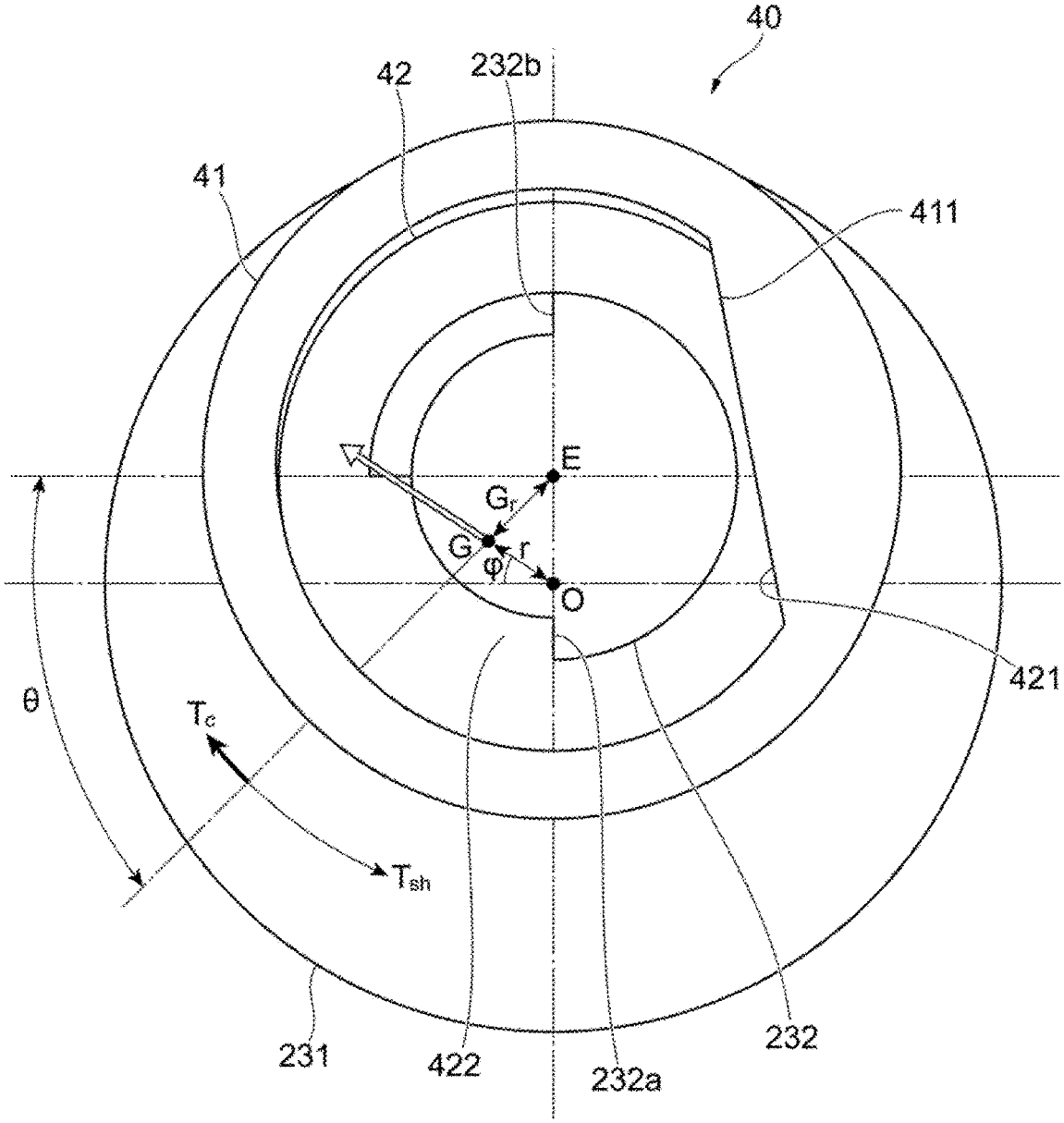
FIG. 2 illustrates a top view of a slide bush portion.

FIG. 2 illustrates a top view of the slide bush portion 40. FIG. 2 is a view illustrating the inside of the casing 30 when viewed from above in a state in which the compression portion 10 of the scroll compressor 1 of FIG. 1 is removed.

As illustrated, the slide bush portion 40 is provided with a slide bush 41 and an inner bush 42 on the main shaft 231 of the rotary shaft 23. The slide bush 41 is an example of a first bush that is installed at the outermost position around the eccentric shaft 232 of the rotary shaft 23 and inserted and coupled to the bearing of the orbiting scroll 12. The inner bush 42 is an example of a second bush that is installed between the slide bush 41 and the eccentric shaft 232, and inserted and coupled to the eccentric shaft 232.

The slide bush 41 and the inner bush 42 have a first slide surface 411 and a second slide surface 421, respectively. The slide bush 41 rotates in accordance with the rotation of the inner bush 42 as the first slide surface 411 is brought into contact with the second slide surface 421 in a plane in the vertical direction. For example, the slide bush 41 and the inner bush 42 rotate about the eccentric shaft 232 without deviating in the circumferential direction. However, the inner bush 42 has a protrusion 422, and thus the rotation of the inner bush 42 is restricted when the protrusion 422 is in contact with stoppers 232*a* and 232*b* of the eccentric shaft 232. On the other hand, by providing a clearance between the slide bush 41 and the inner bush 42, the slide bush 41 is moved with respect to the inner bush 42 such a way that the first slide surface 411 is slidable along the second slide surface 421. For example, the slide bush 41 and the inner bush 42 may be displaced in the direction of the clearance along the first slide surface 411 and the second slide surface 421. In the following, the term "bush" means a member including the slide bush 41 and the inner bush 42.

As illustrated, it is assumed that the center of the main shaft 231 is a point O, the center of the eccentric shaft 232 is a point E and a center of gravity of the bush is a point G based on the top view of the slide bush portion 40. It is also assumed that the point G is at a position delayed in the rotational direction of the rotary shaft 23 with respect to a straight line connecting the point O to the point E. In addition, it also assumed that a length of a line segment OG is r, a length of a line segment EG is $G_r$, an angle between a line segment passing the point O in the horizontal left direction of the drawing and the line segment OG is φ, and an angle between a line segment passing the point E in the horizontal left direction of the drawing and the line segment EG is θ (φ and θ denote the clockwise direction).

Further, as well as a compression load and a centrifugal load, a torque load caused by two kinds torques is applied to the bush. One of the two torques is a first torque (hereinafter it is referred to as "bearing torque ($T_{sh}$)") that is generated by the rotation of the cylindrical portion 123 of the orbiting scroll 12 (refer to FIG. 1). The other of the two torques is a second torque (hereinafter it is referred to as "centrifugal torque ($T_c$)") that is generated by the centrifugal force (it is indicated by a white arrow on the drawings) applied to the center of gravity of the bush.

Next, state transition of the slide bush portion 40 when the rotational speed of the rotary shaft 23 is changed from low speed to high speed will be described.

Figure 3A:
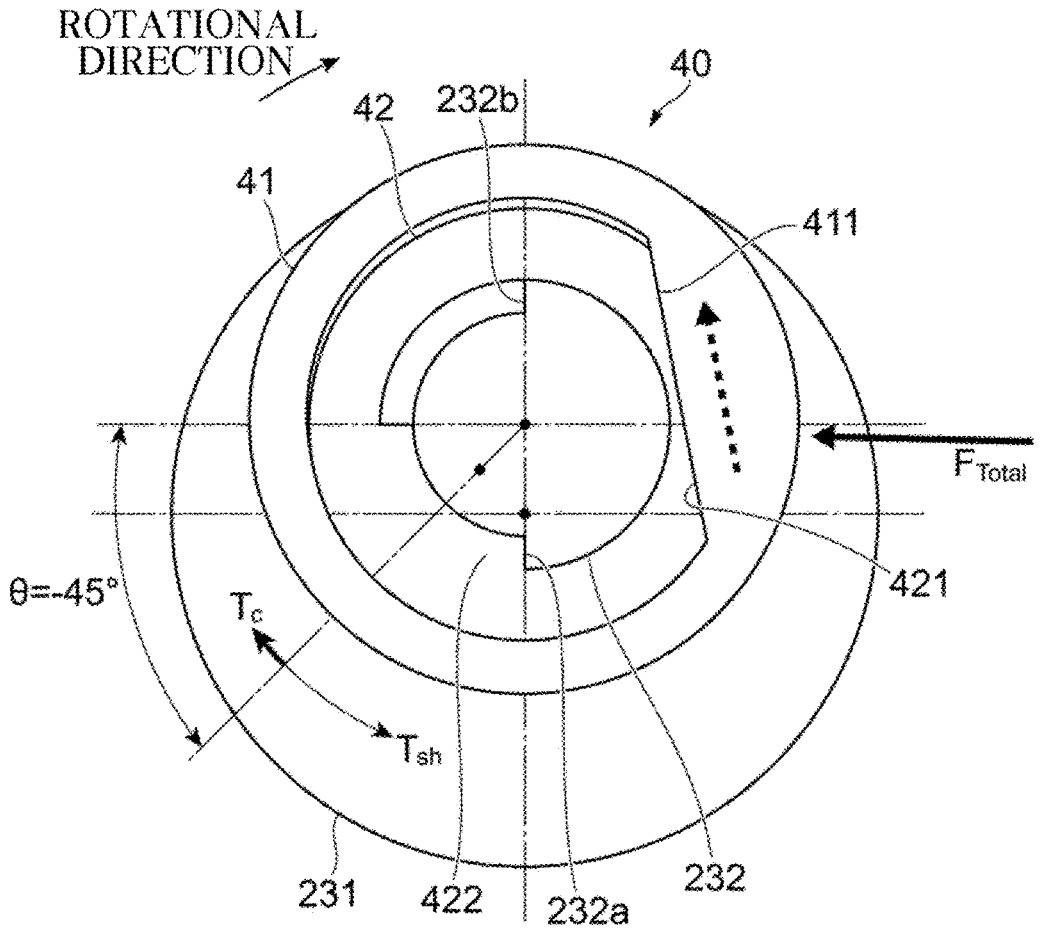
FIG. 3A illustrates a view of the slide bush portion when a rotary shaft is rotated at a low speed.

FIG. 3A illustrates a view of the slide bush portion 40 when the rotary shaft 23 is rotated at a low speed. In this case, because the bearing torque $T_{sh}$ is greater than the centrifugal force torque $T_c$, the inner bush is stabilized when the protrusion 422 of the inner bushing 42 is in contact with the first stopper 232*a* of the eccentric shaft 232. That is, it is stabilized when θ is −45° (θ=−45°). In this state, a load caused by the pressure of the gas and the centrifugal force applied to the orbiting scroll 12 (hereinafter referred to as "orbiting scroll load ($F_{Total}$)") moves the first slide surface 411 of the slide bush 41 along the second slide surface 421 in a direction in which the eccentricity is increased (that is indicated by a broken line arrow). Hereinafter the position of the inner bush 42 in this state will be referred to as "position 1". This position 1 is a position at which the slide bush portion 40 has a structure similar to that of the conventional slide bush portion. Further, the state illustrated in FIG. 3A is an example of a state other than a certain state in which the inner bush 42 rotates around the eccentric shaft 232 to a predetermined angle.

Figure 3B:
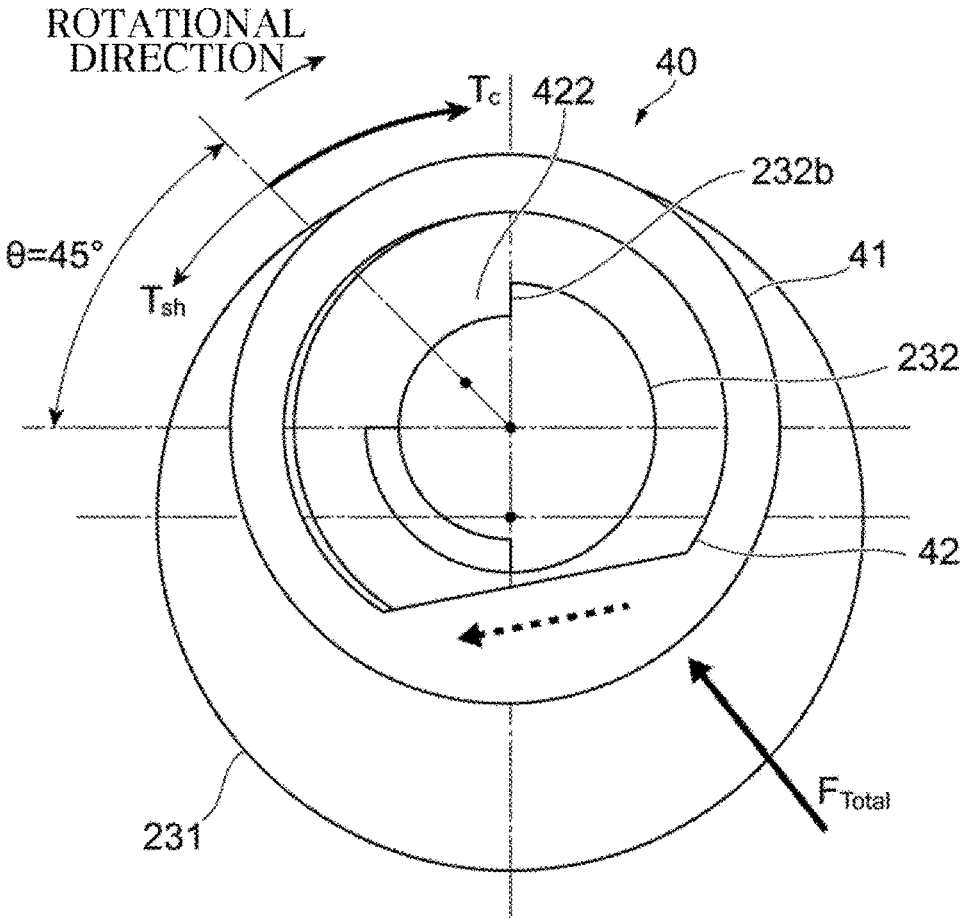
FIG. 3B illustrates a view of the slide bush portion when a rotary shaft is rotated at a high speed.

FIG. 3B illustrates a view of the slide bush portion 40 when the rotary shaft 23 is rotated at a high speed. In this case, because the centrifugal force torque $T_c$ is greater than the bearing torque $T_{sh}$, the bush moves along the eccentric shaft 232 until the protrusion 422 of the inner bush 42 is in contact with the second stopper 232*b*. Accordingly, the eccentricity of the slide bush 41 is fixed, and it is not affected by the centrifugal force on the bush or the orbiting scroll load. A direction indicated by the broken line arrow is an example of a predetermined direction in which the slide bush 41 is slidable so that the eccentricity is reduced by the load on the orbiting scroll 12. Hereinafter a position of the inner bush 42 in this state will be referred to as "position 2". This position 2 is a position at which the slide bush portion 40 has a structure similar to that of a fixed crank structure. Further, the state illustrated in FIG. 3B is an example of a predetermined state in which the inner bush 42 rotates around the eccentric shaft 232 to a predetermined angle, and 90° is an example of the predetermined angle.

In this case, two states illustrated in FIGS. 3A and 3B are described as the state of the slide bush portion 40, but is not limited thereto. For example, the state of the slide bush portion 40 may be three or more states. That is, the state of the slide bush portion 40 may include at least two states in which the inner bush 42 rotates around the eccentric shaft 232 to an angle corresponding to each state.

Next, the state transition of the slide bush portion 40 will be described in more detail.

First, the bearing torque $T_{sh}$ and the centrifugal torque $T_c$ are expressed by the following equations 1 and 2, respectively.

$$T_{sh} = \frac{\pi D^2 L\eta}{2C}\frac{D}{2}\omega \quad (1)$$

$$T_c = G_r m r \omega^2 \sin(\varphi + \theta) \quad (2)$$

m represents the mass of the bush, D represents the diameter of the slide bush portion 40, L represents the height of the slide bush portion 40, η represents the viscosity of the lubricant supplied to the bearing of the eccentric shaft 232, C represents the bearing radial clearance (length obtained by subtracting the radius of the slide bush 41 from the bearing radius of the eccentric shaft 232), and ω represents the rotational speed of the rotary shaft 23. Further, as illustrated in FIG. 2, r is the length between the center O of the main shaft 231 and the center of gravity G of the bush, $G_r$ is the length between the center E of the eccentric shaft 232 and the center of gravity G of the bush, φ is an angle indicating the direction from the center O of the main shaft 231 to the center of gravity G of the bush, and θ is an angle indicating the direction from the center E of the eccentric shaft 232 to the center of gravity G of the bush.

As can be seen from the equations 1 and 2, both the bearing torque $T_{sh}$ and the centrifugal torque $T_c$ become larger as the rotational speed of the rotary shaft 23 becomes larger. However, there is a characteristic difference that the former changes as a leaner function of the rotational speed and the latter changes as a quadratic function of the rotational speed.

Figure 4:
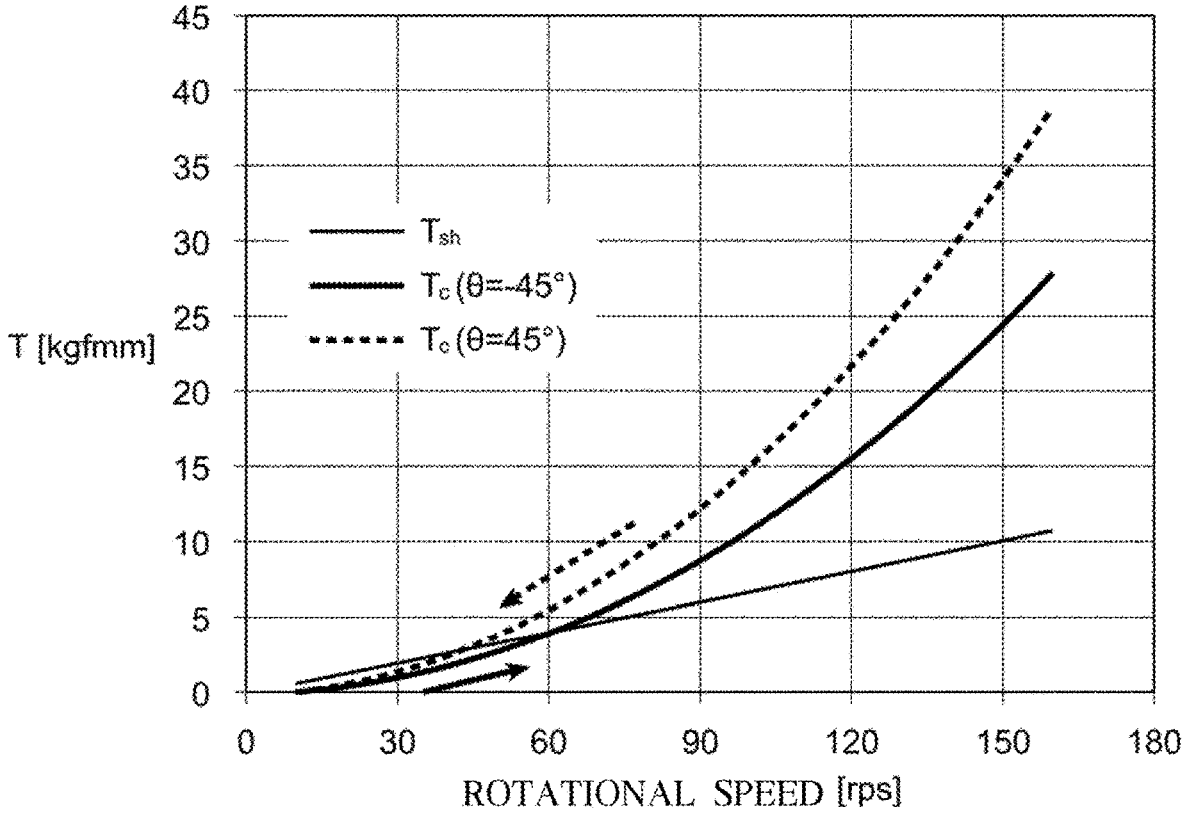
FIG. 4 is a graph illustrating a change of a bearing torque $T_{sh}$ and a centrifugal force $T_c$ when a rotational speed of the rotary shaft changes.

FIG. 4 is a graph illustrating a change of the bearing torque $T_{sh}$ and the centrifugal force $T_c$ when the rotational speed of the rotary shaft changes. A thin line indicates a change in the bearing torque $T_{sh}$, and a thick line indicates a change in the centrifugal force torque $T_c$. In FIG. 2, when θ changes, the center of gravity G rotates about E with $G_r$ kept constant, and thus r and φ have a value depending on θ. Because there are no θ, r and φ on the right side of the equation 1, the bearing torque $T_{sh}$ is constant without depending on θ. However, because there are θ, r and φ on the right side of the equation 2, the centrifugal torque $T_c$ changes depending on θ. Therefore, in FIG. 4, the change in the centrifugal torque $T_c$ is illustrated based on a case in which the lower limit value of θ is −45° and a case in which the upper limit value of θ is 45°. A solid line is the centrifugal force torque $T_c$ in the case in which θ is −45° (θ=−45°) and a broken line is the centrifugal force torque $T_c$ in the case in which θ is 45° (θ=45°). As can be seen from a graph indicated by the thick solid line in FIG. 4, when the rotational speed becomes higher than about 60 rpm, the centrifugal force torque $T_c$ becomes larger than the bearing torque $T_{sh}$, and the bush moves along the eccentric shaft 232 and the position is switched from the position 1 to the position 2. An approximately 60 rpm is an example of a predetermined rotational speed or a rotational speed when the magnitude relation between the bearing torque $T_{sh}$ and the centrifugal torque $T_c$ reverses. In contrast, as can be seen from the graph indicated by the thick broken line in FIG. 4, when the rotational speed becomes less than about 45 rpm from the high speed state, the centrifugal force torque $T_c$ becomes less than the bearing torque $T_{sh}$, and the position of the bush is switched from the position 2 to the position 1. In this case, the upper and lower limit values of θ and the number of rotations upon switching between the position 1 and the position 2 are design items, and may be changed as designed.

Next, a modified example of the slide bush portion 40 according to the embodiment will be described.

Based on the equation 2, it can be seen that the centrifugal force torque $T_c$ depends on the length $G_r$ from the center E of the eccentric shaft 232 to the center of gravity G of the bush. Therefore, by adjusting the position of the center of gravity G of the bush, it is possible to adjust the magnitude of the centrifugal force torque $T_c$.

Figure 5:
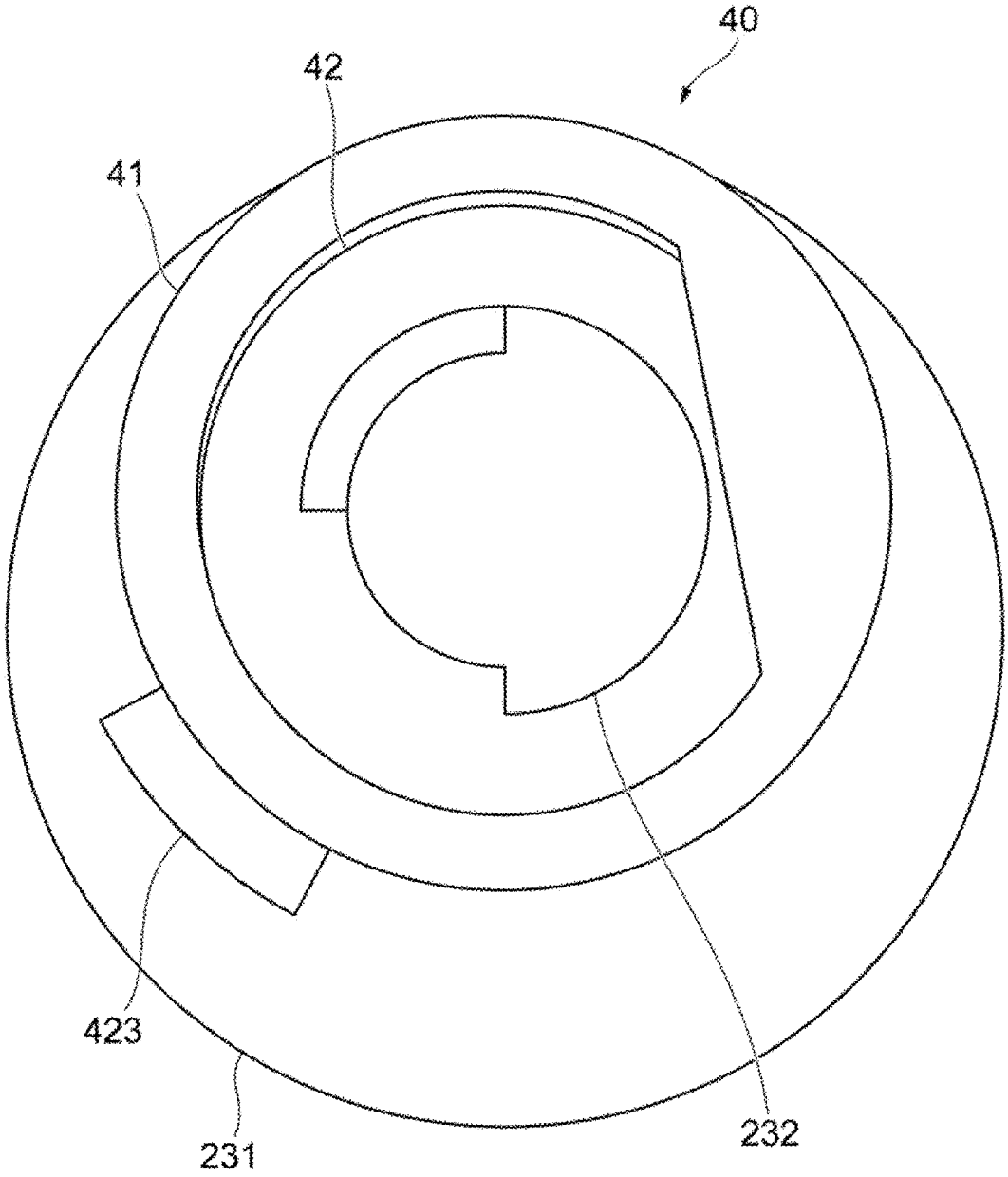
FIG. 5 illustrates a top view of a first modified example of the slide bush portion.

FIG. 5 illustrates a top view of a first modified example of the slide bush portion 40. FIG. 5 is a view illustrating the inside of the casing 30 when viewed from above in a state in which the compression portion 10 of the scroll compressor 1 of FIG. 1 is removed.

The first modified example of the slide bush portion 40 includes a slide bush 41, and an inner bush 42 and further includes a balance weight 423 connected to the inner bush 42. In the first modification, the position of the center of gravity G of the bush is adjusted by installing the balance weight 423. Although the balance weight 423 is connected to the inner bush 42 as described above, a through hole is formed in a portion near the upper surface of the main shaft 231 under the slide bush 41 and then the balance weight 423 is extended to the outside of the slide bush 41 through the through hole. The through hole may have a shape that does not interfere with sliding of the second slide surface 421 of the slide bush 41. Further, the rotation of the orbiting scroll 12 may be not disturbed by the balance weight 423 by making the height of the cylindrical portion 123 of the orbiting scroll 12 shorter that is similar to the height of the balance weight 423. Alternatively, the balance weight 423 may be connected to the slide bush 41. In this sense, the balance weight 423 is an example of a convex portion for adjusting the center of gravity, which is connected to at least one of the slide bush 41 and the inner bush 42.

Figure 6:
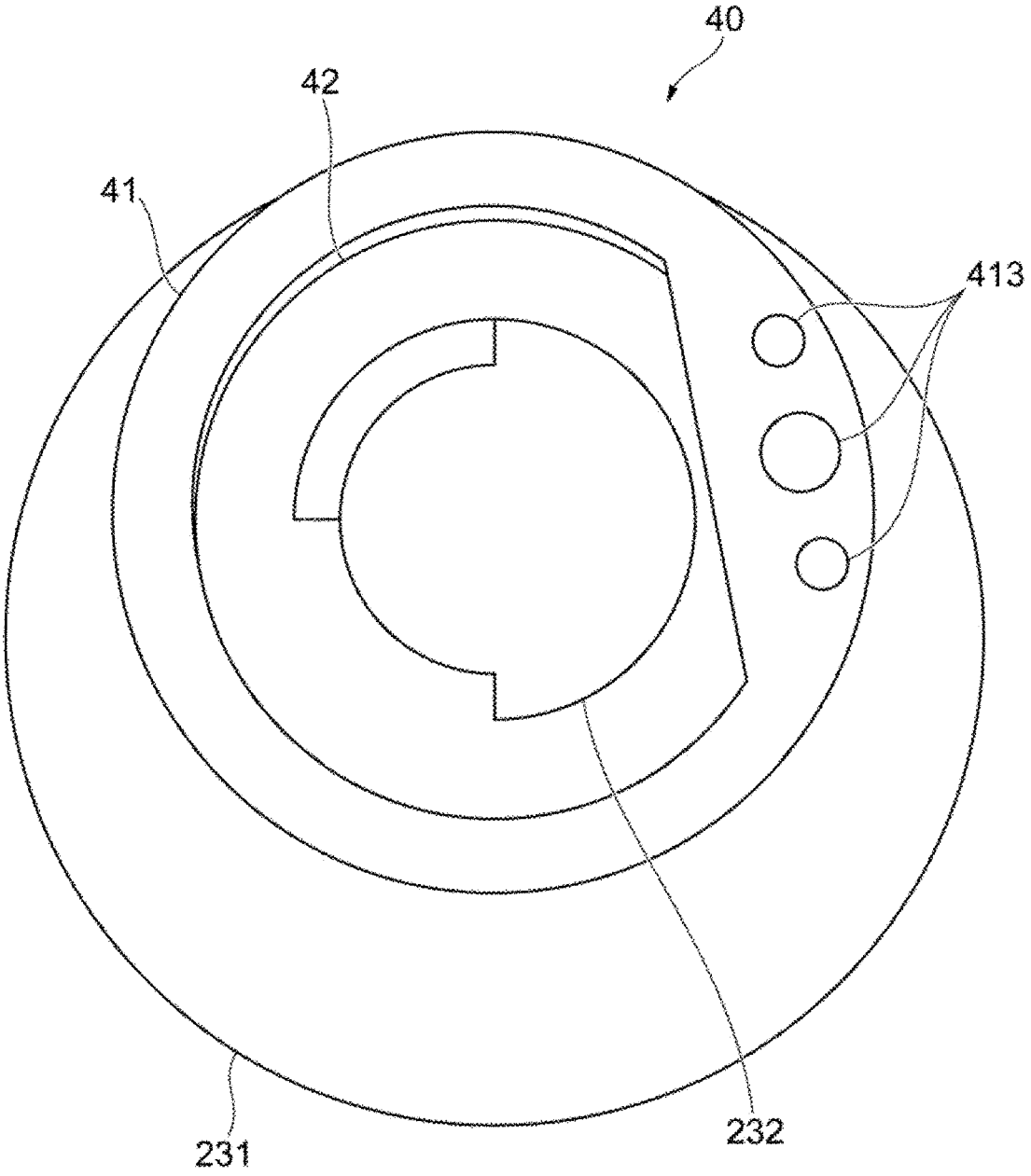
FIG. 6 illustrates a top view of a second modified example of the slide bush portion.

FIG. 6 illustrates a top view of a second modified example of the slide bush portion 40. FIG. 6 is a view illustrating the inside of the casing 30 when viewed from above in a state in which the compression portion 10 of the scroll compressor 1 of FIG. 1 is removed.

The second modification of the slide bush portion 40 is provided with a slide bush 41 and an inner bush 42, and a balance hole 413 is installed on the slide bush 41. In the second modification, the position of the center of gravity G of the bush is adjusted by providing the balance hole 413. Alternatively, the balance hole 413 may be provided in the inner bush 42. In this sense, the balance hole 413 is an example of a concave portion for adjusting the center of gravity, which is installed on at least one of the slide bush 41 and the inner bush 42.

As described above, according to the embodiment, when the rotary shaft 23 is rotated at a high speed, the slide surfaces 411 and 421 between the slide bush 41 and the inner bush 42 is directed to a predetermined direction in which the slide bush 41 is slidable, and thus the eccentricity is reduced by the load on the orbiting scroll 12. Therefore, the eccentricity from the main shaft 231 of the orbiting scroll 12 is reduced. Accordingly, it is possible to suppress the excessive pressing force of the orbiting scroll 12 applied to the fixed scroll 11 at the high speed rotation of the rotary shaft 23.

According to the embodiment, it is possible to suppress the eccentricity of the orbiting scroll 12 from the main shaft 231 at the high speed rotation of the rotary shaft 23. However, it may be understood that the pressing force of the orbiting scroll 12 applied to the fixed scroll 11 is suppressed at the high speed rotation of the rotary shaft 23. Further, it may be understood that the pressing force of the orbiting scroll 12 applied to the fixed scroll 11 is changed in accordance with the rotational speed of the rotary shaft 23.

Suppressing the eccentricity from the main shaft 231 of the orbiting scroll 12 at the high speed rotation of the rotary shaft 23 may include increasing the eccentricity from the main shaft 231 of the orbiting scroll 12 at the low speed rotation of the rotary shaft 23, and fixing the eccentricity from the main shaft 231 of the orbiting scroll 12 at the high speed rotation of the rotary shaft 23, as mentioned in the embodiment. Further, suppressing the pressing force of the orbiting scroll 12 applied to the fixed scroll 11 at the high speed rotation of the rotary shaft 23 may include compressing the orbiting scroll 12 to the fixed scroll 11 at the low speed rotation of the rotary shaft 23 and not compressing the orbiting scroll 12 to the fixed scroll 11 at the high speed rotation of the rotary shaft 23, as mentioned in the embodiment.

As is apparent from the above description, it may be possible to suppress the excessive pressing force of the orbiting scroll applied to the fixed scroll.

Although the present disclosure has been described with various embodiments, various changes and modifications may be suggested to one skilled in the art. It is intended that the present disclosure encompass such changes and modifications as fall within the scope of the appended claims.

What is claimed is:

1. A scroll compressor comprising:

a fixed scroll fixed inside a housing;

an orbiting scroll configured to orbit and be engaged with the fixed scroll;

a rotary shaft configured to allow the orbiting scroll to orbit the orbiting scroll on an eccentric shaft eccentric from a main shaft; and a slide bush portion that is installed between a bearing of the orbiting scroll and the eccentric shaft and, according to a rotational speed of the rotary shaft, configured to change a pressing force of the orbiting scroll applied to the fixed scroll by allowing an eccentricity to be changed by a gas load applied to the orbiting scroll, wherein the slide bush portion comprises:

a slide bush inserted and coupled to the bearing of the orbiting scroll; and an inner bush installed between the slide bush and the eccentric shaft, and wherein a center of gravity of the slide bush and the inner bush is at a position delayed in a rotational direction of the rotary shaft with respect to a straight line connecting a center of the main shaft to a center of the eccentric shaft.

2. The scroll compressor of claim 1, wherein:

the slide bush portion suppresses the pressing force of the orbiting scroll applied to the fixed scroll based on the rotary shaft being rotated at a high rotational speed; and the orbiting scroll compresses the fixed scroll based on the rotary shaft being rotated at a low rotational speed.

3. The scroll compressor of claim 2, wherein the slide bush portion suppresses the pressing force of the orbiting scroll applied to the fixed scroll by suppressing the eccentricity of the orbiting scroll from the main shaft.

4. The scroll compressor of claim 1, wherein:

the slide bush comprises a first slide surface;

the inner bush comprises a second slide surface; and the first slide surface is in contact with the second slide surface so that the slide bush is rotated in accordance with rotation of the inner bush.

5. The scroll compressor of claim 4, wherein:

the eccentric shaft comprises a stopper configured to restrict the rotation of the inner bush; and the inner bush comprises a protrusion configured to restrict the rotation of the inner bush by being in contact with the stopper.

6. The scroll compressor of claim 5, wherein:

a clearance is provided between the slide bush and the inner bush; and the slide bush is moved with respect to the inner bush such that the first slide surface slides along the second slide surface by the clearance.

7. The scroll compressor of claim 6, wherein a first torque, generated by rotation of the bearing of the orbiting scroll, and a second torque, generated by centrifugal force on the slide bush and the inner bush, are applied to the slide bush and the inner bush.

8. The scroll compressor of claim 7, wherein the stopper comprises:

a first stopper configured to restrict a counterclockwise rotation of the inner bush; and a second stopper configured to restrict a clockwise rotation of the inner bush.

9. The scroll compressor of claim 8, wherein, based on the rotary shaft being rotated at a low rotational speed:

the first torque becomes greater than the second torque;

based on the first torque becoming greater than the second torque, a straight line connecting the center of the eccentric shaft to a center of the slide bush and a center of the inner bush is rotated counterclockwise by 45 degrees with respect to a horizontal line passing the center of the eccentric shaft; and based on the straight line rotating counterclockwise 45 degrees, the protrusion is brought into contact with the first stopper, thereby restricting the rotation.

10. The scroll compressor of claim 9, wherein, based on the inner bush being rotated counterclockwise by 45 degrees, the slide bush is moved such that a gas load is applied to the orbiting scroll and the first slide surface slides along the second slide surface in a direction, in which the eccentricity is increased, by the clearance.

11. The scroll compressor of claim 10, wherein, based on the rotary shaft being rotated at a high rotational speed:

the first torque becomes less than the second torque;

based on the first torque becoming less than the second torque, the straight line connecting the center of the eccentric shaft to the center of the slide bush and the center of the inner bush is rotated clockwise by 45 degrees with respect to the horizontal line passing the center of the eccentric shaft; and based on the straight line rotating clockwise 45 degrees, the protrusion is brought into contact with the second stopper, thereby restricting the rotation.

12. The scroll compressor of claim 11, wherein, based on the inner bush being rotated clockwise by 45 degrees, the slide bush is moved such that a gas load is applied to the orbiting scroll and the first slide surface slides along the second slide surface in a direction, in which the eccentricity is reduced, by the clearance.

13. The scroll compressor of claim 7, wherein the first torque changes as a linear function of the rotational speed of the rotary shaft and the second torque changes as a quadratic function of the rotational speed of the rotary shaft.

14. A scroll compressor comprising:

a fixed scroll fixed inside a housing;

an orbiting scroll configured to orbit and be engaged with the fixed scroll;

a rotary shaft configured to allow the orbiting scroll to orbit the orbiting scroll on an eccentric shaft eccentric from a main shaft; and a slide bush portion that is installed between a bearing of the orbiting scroll and the eccentric shaft and configured to change a pressing force of the orbiting scroll applied to the fixed scroll, the slide bush portion comprising:

a slide bush inserted and coupled to the bearing of the orbiting scroll, the slide bush comprising a first slide surface, and an inner bush installed between the slide bush and the eccentric shaft, inserted into the eccentric shaft, coupled to the eccentric shaft, and comprising a second slide surface in contact with the first slide surface to allow the slide bush to be rotated together, wherein:

according to a rotational speed of the rotary shaft, the first slide surface of the slide bush slides along the second slide surface of the inner bush by a gas load applied to the orbiting scroll, and an eccentricity is changed by the first slide surface of the slide bush sliding along the second slide surface of the inner bush.

15. The scroll compressor of claim 14, wherein:

the slide bush portion suppresses the pressing force of the orbiting scroll applied to the fixed scroll based on the rotary shaft being rotated at a high rotational speed; and the orbiting scroll compresses the fixed scroll based on the rotary shaft being rotated at a low rotational speed.

16. The scroll compressor of claim 15, wherein the slide bush portion suppresses the pressing force of the orbiting scroll applied to the fixed scroll by suppressing the eccentricity of the orbiting scroll in the main shaft.

17. The scroll compressor of claim 14, wherein at least one of the slide bush or the inner bush comprises a balance weight configured to adjust a center of gravity of the slide bush and the inner bush.

18. The scroll compressor of claim 14, wherein at least one of the slide bush or the inner bush comprises a balance hole configured to adjust a center of gravity of the slide bush and the inner bush.

* * * * *